United States Patent [19]

Moriguchi et al.

[11] Patent Number: 4,567,488

[45] Date of Patent: Jan. 28, 1986

[54] THERMAL HEAD DRIVE DEVICE

[75] Inventors: Haruhiko Moriguchi; Toshiharu Inui; Masayuki Hisatake; Takashi Ohmori, all of Kanagawa, Japan

[73] Assignee: Fuji Xerox Co., Ltd., Tokyo, Japan

[21] Appl. No.: 686,936

[22] Filed: Dec. 27, 1984

[30] Foreign Application Priority Data

Dec. 28, 1983 [JP] Japan ..... 58-245420

[51] Int. Cl.[4] ..... H05B 1/00

[52] U.S. Cl. ..... 346/76 PH; 346/1.1; 219/216

[58] Field of Search ..... 346/76 PH, 76 R, 1.1; 400/120; 219/216 PH, 492; 250/317.1, 318

[56] References Cited

U.S. PATENT DOCUMENTS 4,284,876 8/1981 Ishibashi et al. ..... 219/216 PH
4,415,908 11/1983 Sugiura ..... 346/76 PH
4,464,669 8/1984 Sekiya et al. ..... 400/120

*Primary Examiner*—E. A. Goldberg
*Assistant Examiner*—A. Evans
*Attorney, Agent, or Firm*—Finnegan, Henderson, Farabow, Garrett & Dunner

[57] ABSTRACT

A method and device for driving a thermal head taking into consideration not only picture data already recorded and picture data on the line containing the aimed data currently being recorded, but also picture data intended to be recorded.

9 Claims, 13 Drawing Figures

THERMAL HEAD DRIVE DEVICE

BACKGROUND

The present invention relates to drive devices used for thermal heads in recording apparatus to make thermal records or for thermal heads in display apparatus to form magnetized latent images.

A conventional thermal head includes a number of aligned heater elements which generate heat according to picture data. Thermal pulses generated by the thermal head elements record picture images in a thermosensitive recording system or a thermal transfer system or form magnetized latent images in a display device.

A recording or a display apparatus having a thermal head makes a record or display (hereinafter collectively referred to as record) using thermal energy. If the energy becomes either excessive or insufficient, the density of the picture and the picture quality deteriorates the risk of picture quality deterioration increases as the unit printing speed (i.e., the printing repetition period) increases (e.g., repetition periods shorter than 10 m sec.) or as the record density increases.

It, therefore, becomes necessary to modify the picture quality to maintain it in good condition. One known thermal head drive apparatus calculates the status of heat storage in a thermal head to adjust the energy to be applied to the thermal head.

FIG. 1 shows an arrangement of picture data which will be referred to show the calculation of heat storage status in a thermal head for the thermal head drive apparatus and methods discussed herein. Data row L1 includes the data on the line currently being recorded. Data row L2, just above row L1, contains the data recorded immediately prior to the current data row L1. In the same manner, data row L5 contains the data recorded four lines previously. In data row L1, data $D_0$, meshed in the drawing is referred to as an "aimed data $D_0$" and corresponds to the heater element with respect to which printing processing is being performed. Ten reference data $D_1$–$D_{10}$, shown hatched in FIG. 1, are reference data used for calculating the heat storage condition.

Reference data $D_1$ and $D_2$, located adjacent to aimed data $D_0$, may have relatively great influence to the printing of the aimed data $D_0$. Reference data $D_4$, which corresponds to the same heater element on the data row L2 may have the greatest influence to the printing of the aimed data $D_0$. The reference data which may influence the heat storage for printing aimed data $D_0$ have different degrees of importance for the calculations of heat storage status depending, for example, on the distance between heater elements and the line printing an interval. The respective reference data $D_1$–$D_{10}$ are thus weighted before being added to each other to calculate the heat storage state. The weighting is performed, for example, as shown in the following Table 1.

TABLE 1

| REFERENCE DATA | | WEIGHT |
|---|---|---|
| $D_1$ | $D_2$ | 7 0 |
| $D_3$ | $D_5$ | 4 5 |
| | $D_4$ | 1 6 0 |
| $D_6$ | $D_8$ | 1 7 |
| | $D_7$ | 1 0 0 |
| | $D_9$ | 6 0 |

TABLE 1-continued

| REFERENCE DATA | WEIGHT |
|---|---|
| $D_{10}$ | 3 6 |

The thermal energy needed to print aimed data $D_0$ is set. In using the numerical values for the heat storage data subjected to weighted addition as described above. That thermal energy may be set by adjusting the width and/or amplitude of the voltage pulse applied to the corresponding heater element of the thermal head.

FIG. 2 shows an example of a conversion relationship between the heat storage state and the applied pulse width in the known apparatus. In FIG. 2, the ordinate indicates width of the pulses applied to the heater element and the abscissa indicates various values for the heat storage state, which are obtained by adding reference data $D_1$–$D_{10}$ weighted according to Table 1. Each value for the heat storage state corresponds to the heat storage data of the heater element corresponding aimed data $D_0$. The heat storage state is zero when all the reference data $D_1$–$D_{10}$ are non-printing data (i.e., white data), and the heat storage state has its maximum value 620 when all the reference data are printing data (i.e., black data).

According to FIG. 2, if the heat storage state for aimed data $D_0$ is 620, the applied pulse width is 0.3 m sec., the narrowest width, because the heat storage condition is at maximum. If the heat storage state is zero, the applied pulse width is 0.5 m sec., the greatest width, because the heat storage condition is at a minimum.

The applied pulse width is not always determined solely on the basis of the heat storage state in this way, in some devices the applied pulse width is set by referring to the pulse width on the preceding line. In both conventional thermal head drive apparatus, the heat storage state is calculated by referring to past picture data and the applied pulse width is reduced as the heat storage progresses.

In these thermal head drive devices, however, it sometimes becomes impossible to perform sufficient heat storage control when the printing speed increases, which caused excessive heat to be stored in the thermal head. In such devices, the heat stored in the thermal head was temporarily proceeded with the printing speed and has partially taken place in the background (i.e., ground color) portion where printing should not take place, which generated a "foggy" image. In a recording apparatus using a heat transfer recording system, this condition causes, on the other hand, not only the ink at a printing portion, but the ink in surroundings of the portion to be transferred to a recording paper (which is ordinary paper) as if a "tail" was trailed which causes the so-called "tail-trailing" phenomenon.

To eliminate this problem, it became necessary to sample many more reference data as the printing speed increased in order to calculate the present heat storage state. This, however, increased the size of the circuit portion in the thermal head drive device and made the device expensive. Furthermore, sufficient picture density could not be obtained if the energy applied to a recording paper or a thermal recording medium, such as an ink donor film, was suppressed to a low value to avoid a "foggy" image or "tail-trailing."

It is an object of the present invention to eliminate the disadvantages in the prior art thermal head drive devices. Another object of the present invention is a thermal head drive device which performs the proper adjustment of energy applied to heater elements even when the printing speed increases.

SUMMARY OF THE INVENTION

To achieve the objects of this invention, the thermal head drive device of this invention for applying to an aimed data heater element of a thermal head a pulse to record aimed data in one of several lines of picture data comprises: first means for storing data representing lines of picture data already recorded; second, means for storing data representing lines of picture data intended to be recorded in the future; and means, coupled to the first and second storing means, for determining from the line of picture data containing the aimed data and from the data stored in the first and second storing means, the amount of energy in the pulse to be applied to the aimed data heater element to record the aimed data.

BRIEF DESCRIPTION OF THE DRAWINGS

FIGS. 4 to 9 are diagrams for explaining an embodiment of the present invention, in which:

FIG. 4 is a block diagram of a main part of a thermal head drive device and a part of a recording apparatus;

FIG. 5 is a diagram showing the relationship between the printing portion of picture data produced from the latch circuit in FIG. 4 and the address information, FIGS. 6 and 7 are diagrams of the state of arrangement of the picture data around the aimed data, FIG. 8 is a block diagram showing a part of the thermal head driving circuit, and FIG. 9 is a time chart showing the control of the applied pulse width;

Figure 1:
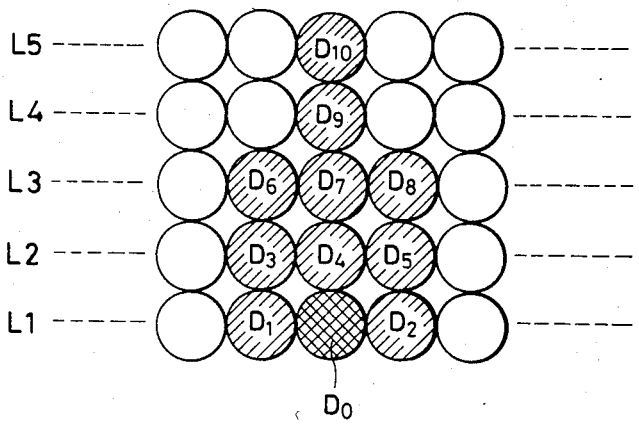
FIG. 1 shows the arrangement of the picture data for calculating the heat storage state in a known thermal head drive device.
Figure 2:
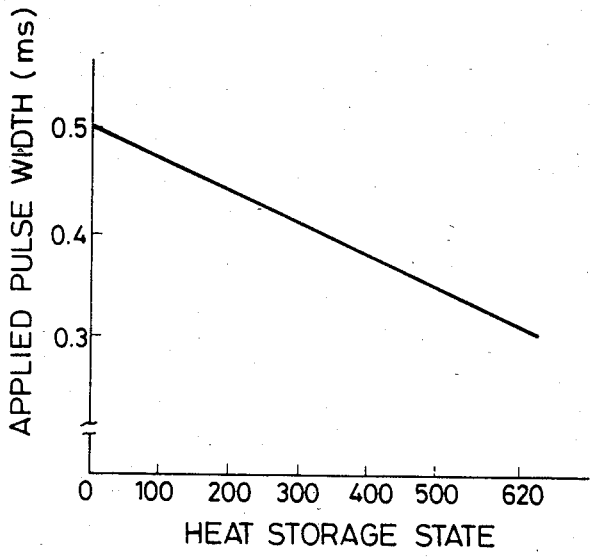
FIG. 2 is a diagram showing the relation between the calculated heat storage state and the applied pulse width.
Figure 3:
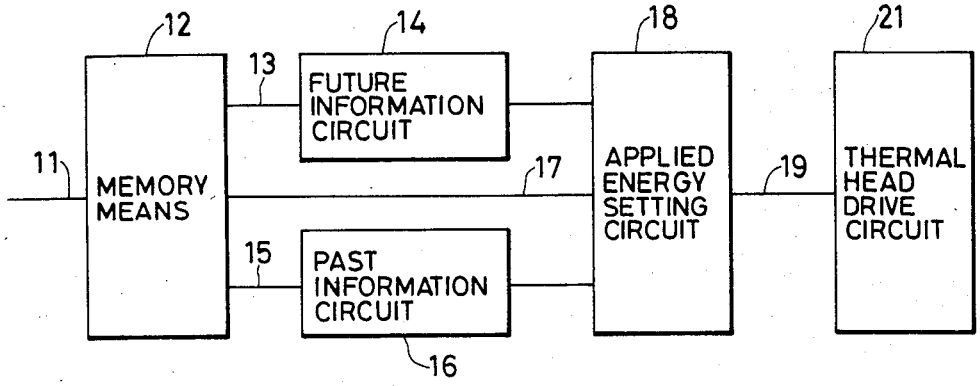
FIG. 3 is a block diagram demonstrating the principle of the present invention.

Detailed description of the preferred embodiments in FIG. 3 shows a thermal head drive device comprising a memory 12 for successively storing picture data 11. Future information circuit 14 judges the printing state of the thermal head for a future printing process on the basis of delayed picture data 13 which has been stored in memory 12 for the prescribed delay time. Past information circuit 16 determines the printing state of the thermal head for a past unit printing process on the basis of delayed picture data 15 stored in memory 12 for another prescribed delay time. Applied energy setting circuit 18 sets the energy for heater elements in a present unit printing process on the basis of present picture data 17 stored in the memory means 12 and the determined past and future printing states from future information circuit 14 and past information circuit 16. Thermal head drive circuit 21 drives the heater elements with the set applied energy 19 from circuit 18. The "printing state" includes not only the state of two-dimensional picture data arrangement, but also the state of information obtained by processing those picture data, such as the pulse width information obtained for adjusting the thermal energy.

Thus, according to the present invention, future picture data as well as past picture data are taken into consideration making it possible to adjust past storage of thermal energy as well as future applied energy when, for example, the future information judging circuit detects the start or end of a solid portion. This, the present invention can adapt to increases in printing speed.

The energy applied to the heater elements in the thermal head may be adjusted by controlling either the width or amplitude of the applied pulse. The unit process of printing is a raster printing process for a thermal head containing a number of heat elements are arranged in one row, and a line printing process for a thermal head containing heat elements arranged in a matrix.

Figure 4:
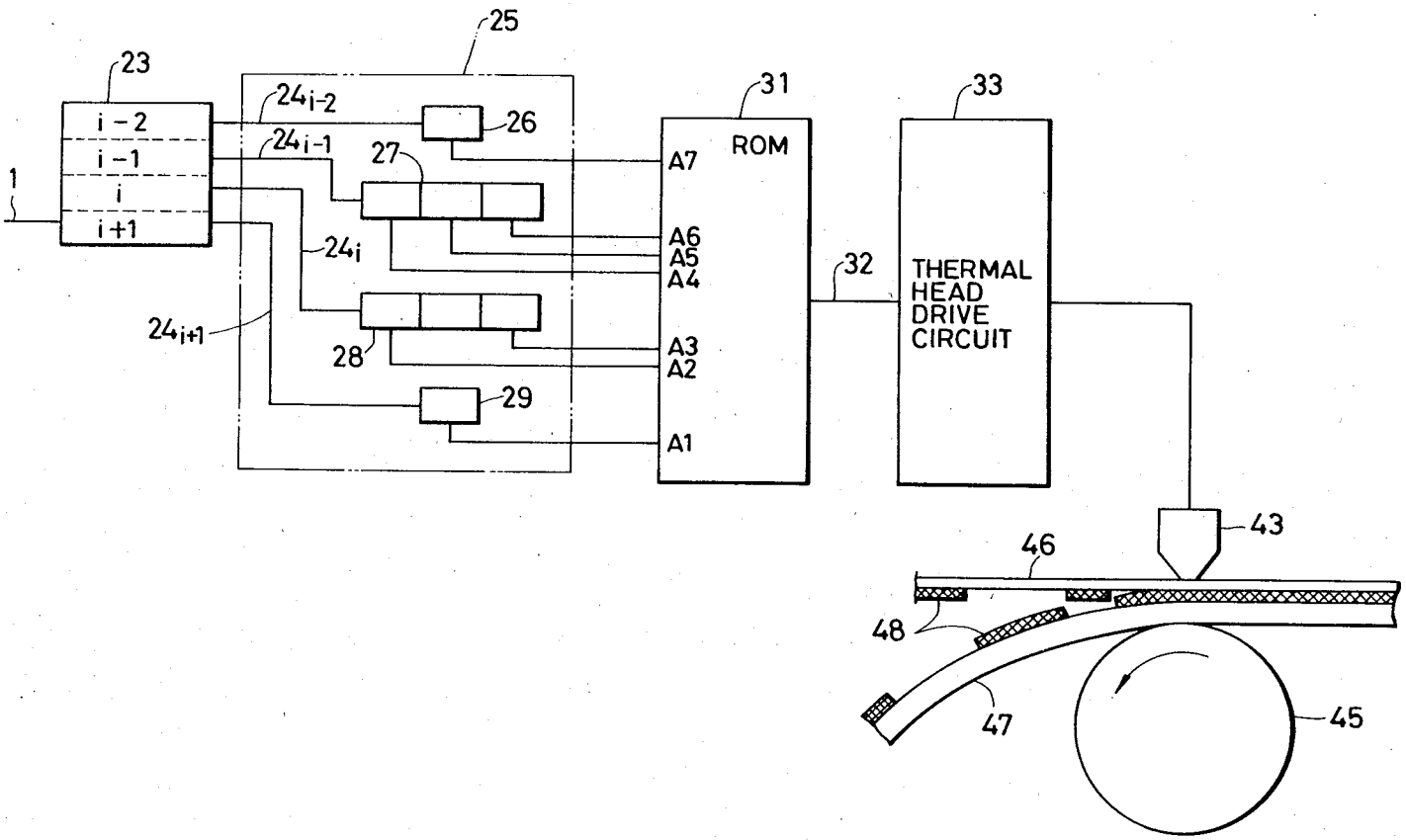

FIG. 4 shows the main portion of the thermal head drive device and a part of the recording section connected with the thermal head drive device. The thermal head drive device in this embodiment has a buffer memory (memory means) 23 for storing four lines (or four rasters) of picture data 11. Hereinafter, the line currently being printed will be referred to as the "i-line," the line which will be printed next (one line future) will be referred to as the "(i+1)-line," the line which has been printed immediately prior (one line past) will be referred to as the "(i−1)-line," and the line which was printed one line before the (i−1)-line (that is two lines past 0 will be referred to as, the "(i−2)-line." Buffer memory 23 stores picture data for the (i+1)-line to the ((i−2)-line. From the buffer memory 23, picture data $\mathbf{24}_{i+1}$ to $\mathbf{24}_{i-2}$ for the respective lines are simultaneously read out to ratch circuit 25 in bit serial format and in synchronism with a clock signal not shown.

In ratch circuit 25, four ratches 26 to 29 are arranged to match the clock synchronized data. The picture data $\mathbf{24}_{i-2}$ (two-lines past) are delayed by one bit by a delay element not shown and are supplied to ratch 26. The picture data $\mathbf{24}_{i-1}$ (one-line past) and the picture data $\mathbf{24}_{i}$ (present) are supplied to ratches 27 and 28, respectively, each a three-stages shift register. Picture data $\mathbf{24}_{i+1}$ (one line future are also delayed by one bit by a delay element (not-shown) and are supplied to ratch 29.

The picture data bit held in ratch 26 is supplied to address terminal A7 of ROM (read only memory) 31. The three-bits of picture data held in ratch 27 are serial parallel converted and supplied in the proper order (oldest to newest) to address terminals A6 to A4 of ROM 31. The three-bits of picture data held in ratch 28 are also serial parallel converted and the (oldest to the newest) bits are supplied to address terminals A3 and A2, respectively of ROM 31. The picture data bit held in ratch 29 is supplied to address terminal A1 of ROM 31.

Figure 5:
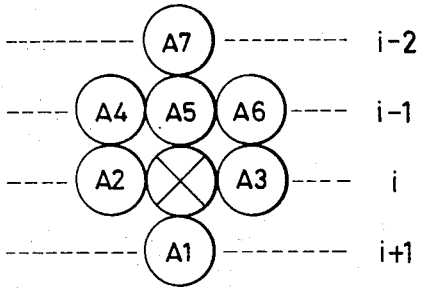

FIG. 5 shows the relationship between the printing positions of the data from ratch circuit 25 and the address terminals of the ROM 31. The picture data shown by the X is the aimed data.

The ROM 31 "calculates" the heat storage state of the heater element corresponding to the aimed data by using the reference picture data surrounding the aimed data as address information. Table 2 shows the contents of a conversion table in ROM 31.

TABLE 2

| PICTURE DATA (ADDRESS TERMINALS) | | | | | | | APPLIED PULSE WIDTH DATA |
|---|---|---|---|---|---|---|---|
| A1 | A2 | A3 | A4 | A5 | A6 | A7 | (m sec.) |
| 0 | 0 | 0 | 0 | 0 | 0 | 0 | 1.2 |
| 0 | 0 | 0 | 0 | 0 | 0 | 1 | 1.1 |
| 0 | 0 | 0 | 0 | 0 | 1 | 0 | 1.1 |
| 0 | 0 | 0 | 0 | 0 | 1 | 1 | 1.05 |
| | | | . | | | | . |
| | | | . | | | | . |
| | | | . | | | | . |
| 0 | 1 | 1 | 1 | 1 | 1 | 1 | 0.4 |
| 1 | 0 | 0 | 0 | 0 | 0 | 0 | 1.2 |
| 1 | 0 | 0 | 0 | 0 | 0 | 1 | 1.15 |
| 1 | 0 | 0 | 0 | 0 | 1 | 0 | 1.15 |
| 1 | 0 | 0 | 0 | 0 | 1 | 1 | 1.1 |
| | | | . | | | | . |
| | | | . | | | | . |
| | | | . | | | | . |
| 1 | 1 | 1 | 1 | 1 | 1 | 1 | 0.8 |

In the columns of picture data (address terminals), the numeral "1" corresponds to printing picture data (black picture data) and the numeral "0" corresponds to non-printing picture data (white picture data). In this manner, the pulse width to be applied to the heater element corresponding to the aimed data is determined according to the surrounding picture data. The pulse having its width determined in this manner is supplied as applied pulse width data 32 to a thermal head drive circuit 33.

Figure 6:
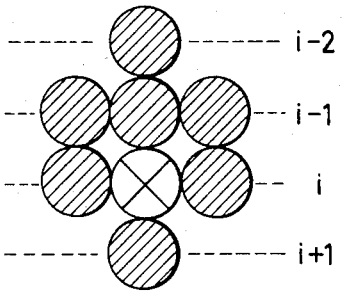

If, as shown in FIG. 6, all the seven picture data bits surrounding the aimed data (designated by the X) are printing data (denoted by the cross hatching). In this case, resolution is not a problem if the printing dot becomes large. If the size of a printing dot is small, gaps with the ground color occur between printing dots making it impossible to print solid black portions. In this case, therefore, the pulse width is set at a larger value than that which would be simply calculated from the heat storage state. In Table 2, the applied pulse width in this case is 0.8 m. sec.

Figure 7:
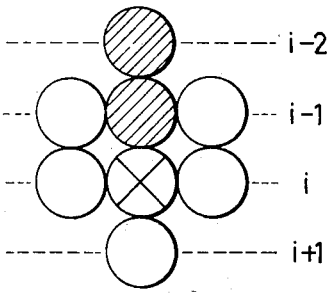

In the quantity of heat storage is small, the width of the applied pulse for the heater elements is generally set larger to adjust the printing density. There are some cases, however, for example the situation shown in FIG. 7, in which the picture data for a column next to the column containing the aimed data are non-printing data (i.e., white portion) or in which the picture data adjacent to the aimed data on the same line are non-printing data, even if the quantity of heat storage is smaller than that in the case shown in FIG. 6. In such cases, if the applied energy is simply calculated, the printing dot has a relatively large size, causing a lack of clarity at the edge portions when the black and white portions are reversed. Accordingly, in such cases, the applied pulse width is set at a smaller value than what would normally be calculated.

Figure 8:
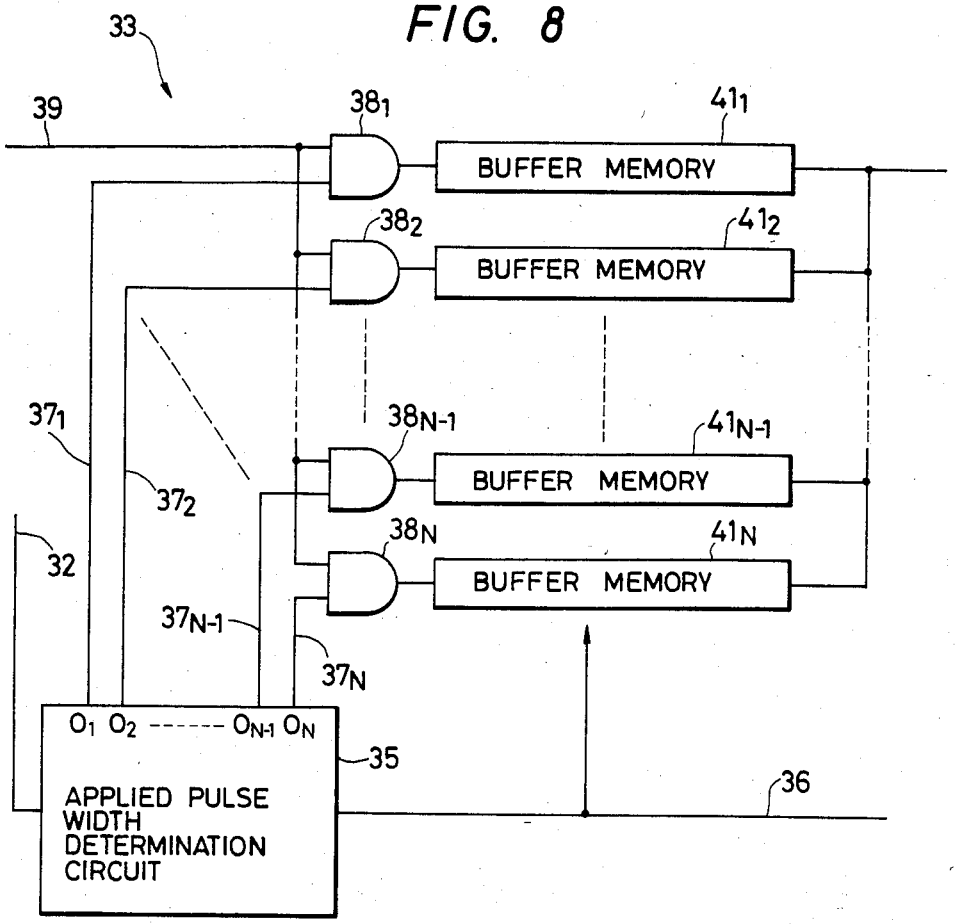

FIG. 8 shows an embodiment of a part of the thermal head drive circuit for setting the width of applied pulse on the basis of such applied pulse width data. Applied pulse width determination circuit 35 of thermal head drive circuit 33, supplied with the applied pulse width data 32 in synchronism with clock signal 36, produces gate control signals $37_1$–$37_N$ in accordance with the applied pulse width from its output terminals $0_1$–$0_N$. Applied pulse width determination circuit 35 classifies the printing pulse widths into N stages from 0.4 m sec. to 1.2 m. sec. and adjusts the quantity of heat generated in the heater elements. When the applied pulse width is 0.4 m. sec., only the first gate control signal $37_1$ have an H (high) level. When the applied pulse width is 0.5 m sec., each of the first and second gate control signals $37_1$ and $37_2$ have an H level. Applying the same rule, the number of the gate control signals simultaneously having an H level is increased by one as the applied pulse width increases, until the applied pulse width is 1.2 m. sec. when all the gate control signals $37_1$–$37_N$ have an H level.

Figure 9:
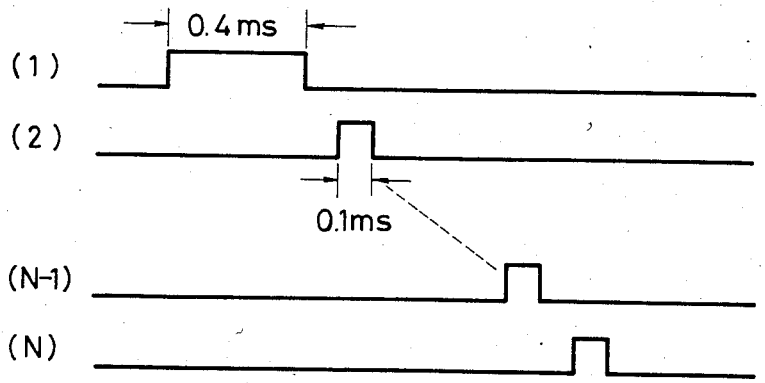

Gate control signals $37_1$–$37_N$ are each applied to a different one of 2-inputs AND gates $38_1$–$38_N$. The other input terminals of these AND gates $38_1$–$38_N$ picture data 39 for the aimed data. Thus, for example, if the applied pulse width is 0.4 m sec. when H-level printing data are supplied as picture data 39, an H-level signal is produced from the first AND gate $38_1$. At the same time, an L-level signal is produced from each of the other AND gates $38_1$–$38_N$. These output signals from the AND gates $38_1$–$38_N$ are applied to N buffer memories $41_1$–$41_N$ arranged to correspond to AND gates $38_1$–$38_N$, respectively. The operations described above are repeated in synchronism with clock signal 36 so that picture data for one line are assigned to and stored in buffer memories $41_1$–$41_N$. Thereafter, buffer memory $41_1$ is shifted by one bit to transfer the output into a shift register (not shown) in thermal head 43 (FIG. 4). As shown in FIG. 9(1), this generates a printing pulse having a width of 0.4 m. sec. and the first step of the printing operation is performed. Then, buffer memory $41_2$ is one bit shifted and its output is transferred to the above-mentioned shift register. In this case, as shown in FIG. 9(2), a printing pulse of 0.1 sec. is generated and the second step of the printing operation is performed. Similarly, the contents of buffer memories $41_3$–$41_N$ are successively shifted and read out and used to generate applied pulses each having a predetermined width.

Until the Nth step of printing operation (FIG. 9(N) has been completed, back roller 45 is stationary, and both ink doner sheet 46 and recording paper (ordinary paper) 47 used as a thermally recording medium are suspended from moving in the sub-scanning direction. At this time, by adjusting the N stages of applied pulse widths, the most suitable thermal energy is generated in each of the heater elements and thermally transferable ink 48 is transferred from the ink donor sheet 46 onto recording paper 47.

When the N-step printing operation has been completed, the back roller 45 is sub-scanned by one line only, and both ink donor sheet 46 and recording paper 47 are moved to the next printing position. Thus, the printing operation is repeated to record the picture data.

Figure 10:
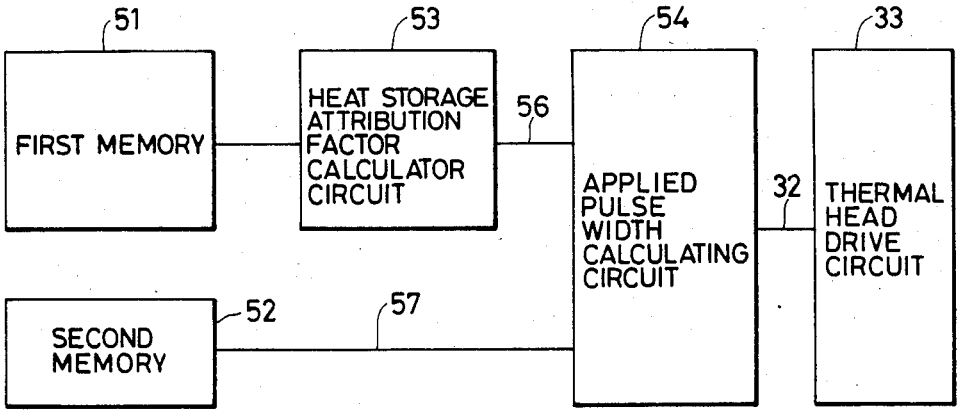
FIG. 10 is a block diagram of a first modification of the thermal head drive device of this invention.

FIG. 10 shows the arrangement of a first modification of the thermal head control device of this invention. This device comprises first and second memories 51 and 52 for storing picture data. The first memory 51 comprises a plurality of line buffer memories for storing picture data for a present printing line and one or more past printing lines. The second memory 52 comprises line buffer memories for storing data for one or more future picture lines.

Heat storage attribution factor calculator circuit 53 has a circuit portion for calculating the heat storage state in the heater elements corresponding to the aimed data on the basis of the present and past picture data. In this first modification, the heat storage state for each heater element is calculated and control is made so that when heat storage increases the applied pulse width is shortened and when heat storage decreases the applied pulse width is lengthened. Applied pulse width calculating circuit 54 sets the applied pulse width.

Applied pulse width calculating circuit 54 receives information with respect to the future picture data from the second memory 52, and sets the applied pulse width taking the received information into consideration. For example, where printing date (black data) will continue successively, the applied pulse width is set relatively longer so that adjacent printing dots will be larger to prevent gaps. On the other hand, where the printing data will be interrupted, the applied pulse width is set relatively shorter to sharpen the printing edges. Thermal head drive circuit 33 controls every heater element of the thermal head in accordance with the applied pulse width data 32 set in the manner as described above.

Figure 11:
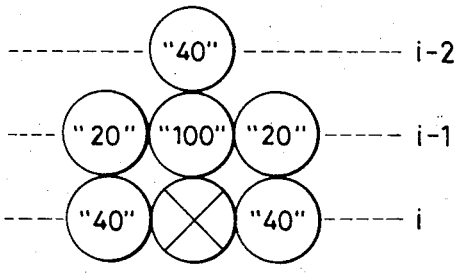
FIG. 11 is a diagram showing the weighting of picture data in the modification in FIG. 10.

FIG. 11 shows the principle of calculating the heat storage state by heat storage attribution factor calculator circuit 53. The weight for the picture data for the i-line which contains the aimed data (represented by the "X") has a weight of 100. The respective weights for the seven kinds of picture data around the aimed data are as shown in FIG. 11 if the heat storage attribution factor is taken into consideration. The heat storage attribution factor calculator circuit 53 calculates the weight only for printing data (black picture data). The heat storage data 56 thus obtained are applied to the applied pulse width calculator circuit 54 together with future surrounding data 57 produced from second memory 52. The applied pulse width calculator circuit 54 forms the applied pulse width 32 by using the received data as address information.

Alternatively, instead of applying the surrounding future data 57 used in the first modification into the applied pulse width calculator circuit 54, the surrounding future data 57 may be directly applied to the thermal head drive circuit 33 to adjust the applied pulse width.

Figure 12:
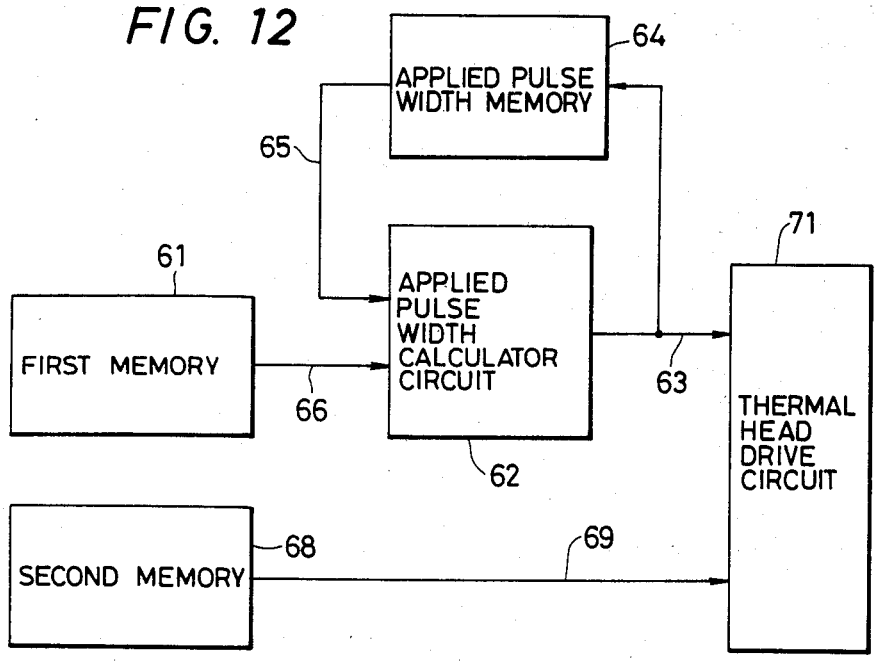
FIG. 12 is a block diagram of a second modification a thermal head drive device of this invention.

FIG. 12 shows a second modification of the thermal head drive device of this invention. First memory 61 successively stores one or more lines of future picture data. Applied pulse width calculator circuit 62 calculates the applied pulse width in printing the aimed data. Applied pulse width data 63 obtained as the result of calculation of applied pulse width calculator circuit 62 are stored in applied pulse width memory 64, and delayed by one line to form one line past applied pulse width data 65. Applied pulse width data 65 represent a plurality of reference data located around the aimed data.

Applied pulse width calculator circuit 62 forms the above-mentioned applied pulse width data 63 by using as address information the past data 65 and the future data 66 produced from first memory 61. Applied pulse width calculator circuit 62 is provided with a ROM containing a conversion table for the above-mentioned calculation.

A second memory 68 is a buffer memory for storing picture data for current printing and for producing aimed data 69 in synchronism with the output of applied pulse width data 63. Thermal head drive circuit 71 drives the heater elements with an applied pulse whose width is indicated by the applied pulse width 63 when the aimed data 69 are printing data, but does not drive the heater elements when the aimed data are non-printing data. In this manner, the device in FIG. 12 performs heat generation control for every heater element by referring to the past and future picture data.

In the second modification, first memory 61 may also store the present picture data, in which case the second memory 68 becomes unnecessary.

Figure 13:
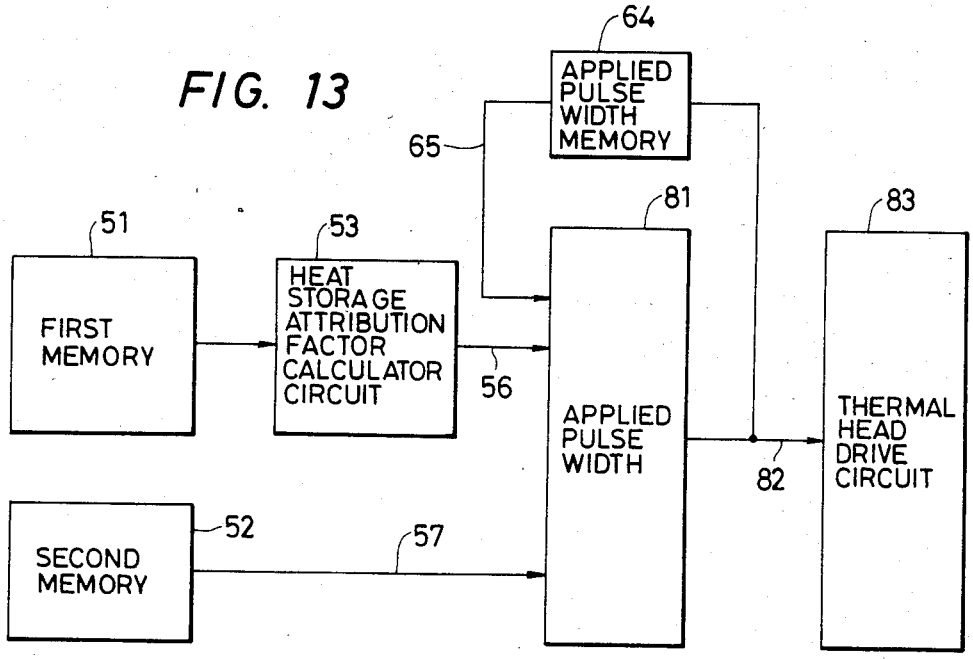
FIG. 13 is a block diagram of a third modification a thermal head drive device of this invention.

FIG. 13 shows a third modification of the thermal head drive device according to this invention. In FIG. 13, first and a second memories 51 and 52 and heat storage attribution factor calculator circuit 53 are the same as those described in FIG. 10. Applied pulse width memory 64 is the same as that described in FIG. 12. Applied pulse width calculator circuit 81 forms applied pulse width data 85 for the aimed data by using an address information heat storage data 56, future picture data 57 and the previous lines applied pulse width data 65. Thermal head drive circuit 83 performs drive control for the thermal head with respect to every heater element in accordance with applied pulse width data 82. Second memory 52 may store not only the future picture data but also the present printing line picture data.

Although the thermal head drive device in FIG. 13 is more complicated than previous embodiments, it permits tracking of the thermal history of each heater element for a long time by the applied pulse width memory, and helps meet the demands of higher recording speeds.

The present invention has been described with the help of representative embodiments, but the present invention is not necessarily limited to the details explained in describing these embodiments. For example, the picture data need not only represent black and white. The present invention can be applied to other than black ink and other than a white ground color. Furthermore, in addition to the two-valued color recording it is possible to apply the present invention to multi-valued recording with half-tone colors.

In addition, there is no limit to the numbers of the picture data and lines which are used to determine the applied energy. One may set those numbers according to the printing speed and required picture quality. Sufficient improvement in picture quality has been noted when the thermal head drive device of this convention was used in a printing process with a repetition period of 2.4 m. sec.

The applied energy may also be determined using information such as the temperature of the thermal head substrate, the temperature of recording paper, the voltage characteristic of the power source for the thermal head drive, and the resistance value of each of the heater elements of the thermal head. Also, the applied pulse energy may be controlled not only by the control of applied pulse width, but also by the control of current and/or voltage.

Furthermore, the thermal head need not be linear in which heater elements are disposed in one row. It is possible to control a thermal head having heater elements arranged in a two-dimensional matrix. The present invention can be of course applied to a thermal head with only one heater element.

The thermal head drive device of this invention can also be applied to a display device, such as a thermo-sensitive display employing a thermo-sensitive display medium or a thermo-magnetrographic device utilizing thermo-magnetic phenomena.

According to the invention, as described above, a sharp picture of high resolution can be obtained with a relatively inexpensive circuit arrangement even if the printing speed exceeds the speed of heat generation and heat radiation (cooling) of the thermal head, because the applied energy is determined by referring to the past and future picture data.

What is claimed is:

1. A thermal head drive device for applying to an aimed data heater element of a thermal head a pulse to record aimed data in one of several lines of picture data, said device comprising:

first means for storing data representing lines of said picture data already recorded;

second means for storing data representing lines of said picture data intended to be recorded after the line of said picture data containing said aimed data is printed, and means, coupled to said first and second storing means, for determining, from the line of said picture data containing said aimed data and from said data stored in said first and second storing means, the amount of energy in said pulse to be applied to said aimed data heater element to record said aimed data.

2. The device of claim 1 wherein said determining means comprises means for adjusting the width of said applied pulse.

3. The device of claim 1 wherein said determining means includes various means for setting said applied energy amount based on said stored data and from said aimed data line of said picture data, and a thermal head drive circuit coupled to said setting means, for combining said set applied energy amount and said aimed data.

4. The device of claim 3 wherein said thermal head drive circuit includes:

means for generating a first number of gate control pulse signals from said set applied energy amount such that the number of said pulses signals simultaneously having the same level is indicative of the value of said set applied energy amount;

a first number of gates each having as a first input a different one of said gate control pulse signals and as a second input said picture data; and a first number of registers, each having an input coupled to the output of a different gate, said registers storing data to determine the amount of energy for said aimed data heater element.

5. The device of claim 1 wherein said determining means includes a ROM containing values for said applied energy amount and wherein the addresses for said ROM are determined from said stored data and said line of picture data currently being printed.

6. The device of claim 1 further including a buffer for storing successive lines of said picture data and a first register for temporarily storing selected portions of said picture data is said line containing said aimed data, and wherein said first and second storing means each include registers for temporarily storing data from said lines of picture data in said buffer.

7. The device of claim 1 wherein said first and second storing means include a first and second memory, respectively, and wherein said determining means includes a heat storage attribution factor calculator circuit coupled to said first memory to calculate a heat storage stall for said aimed data heater element.

8. The device of claim 1 wherein said first storing means includes an applied pulse width memory coupled between an output and an input of said determining means to store information about picture data already recorded.

9. A method of driving a thermal head to control an aimed data heater element to record aimed data in picture data, said method comprising the steps of:

storing first lines of said picture data that have already been recorded;

storing second lines of said pictures of data intended to be recorded after a line of said picture data containing said aimed data is printed; and determining the amount of energy to be applied to said aimed data heater element from said first and second lines of stored data and from data in said line of picture data containing said aimed data.

* * * * *